United States Patent [19]

Hastings

[11] 4,139,155

[45] Feb. 13, 1979

[54] ELECTROSTATIC SPRAY GUN WITH ISOLATING PAINT CONDUIT

[75] Inventor: Donald R. Hastings, Elyria, Ohio

[73] Assignee: Nordson Corporation, Amherst, Ohio

[21] Appl. No.: 800,255

[22] Filed: May 25, 1977

[51] Int. Cl.[2] ..... B05B 5/02

[52] U.S. Cl. ..... 239/708

[58] Field of Search ..... 239/3, 15, DIG. 19; 118/620–636

[56] References Cited

U.S. PATENT DOCUMENTS

| | | | |
|---|---|---|---|
| 2,739,838 | 3/1956 | Sedlacsik | 239/15 |
| 2,784,350 | 3/1957 | Sedlacsik | 239/15 |
| 3,037,703 | 6/1962 | Croskey et al. | 239/15 |
| 3,148,831 | 9/1964 | Point | 239/15 |
| 3,735,925 | 5/1973 | Benedek et al. | 239/15 |
| 3,747,850 | 7/1973 | Hastings et al. | 239/3 |
| 3,794,243 | 2/1974 | Tamny et al. | 239/3 |

FOREIGN PATENT DOCUMENTS

| | | | |
|---|---|---|---|
| 2111271 | 9/1971 | Fed. Rep. of Germany | 239/15 |
| 2082706 | 12/1971 | France | 239/15 |

*Primary Examiner*—Robert B. Reeves
*Assistant Examiner*—Andres Kashnikow
*Attorney, Agent, or Firm*—George J. Coghill

[57] ABSTRACT

In a hand held electrostatic type spray coating gun a removable cartridge lengthens the paint supply conduit between the base of the grounded handle and the barrel so that the gun can be used to spray paints which have moderate electrical conductivities such as those containing metallic particles. The cartridge includes a Teflon tube in the form of an elongated spiral. Fluid connections at each end of the cartridge allow the cartridge to be easily removed and stored, and a straight conduit substituted for it when it is not needed, for example when the gun is to be used for nonconductive paints. The location of the cartridge facilitates removal, and combines with the gun to provide a well balanced device for hand held operation.

12 Claims, 1 Drawing Figure

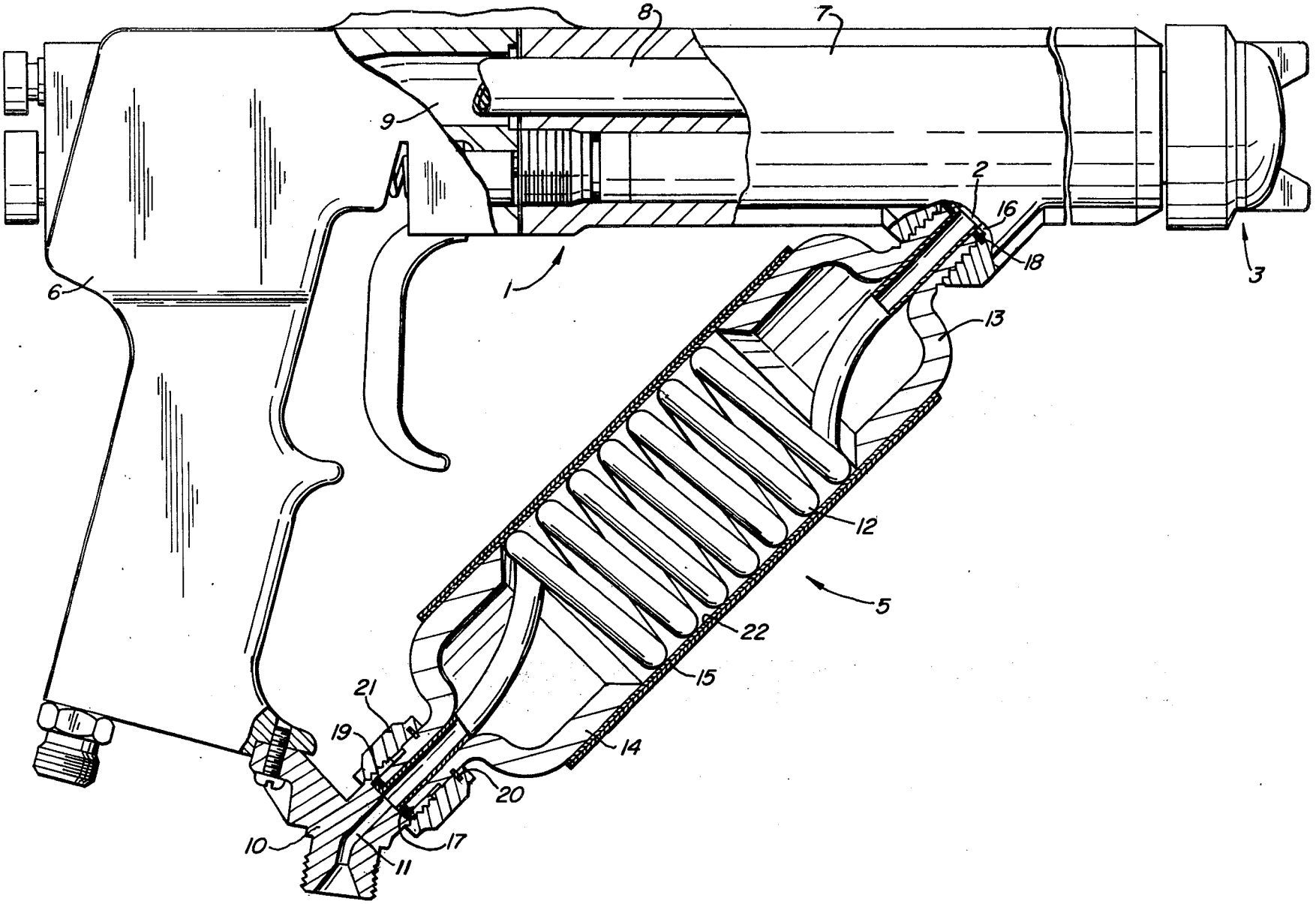
3
18
16
2
13
7
12
5
22
8
15
14
1
20
17
9
11
21
19
10
6

ELECTROSTATIC SPRAY GUN WITH ISOLATING PAINT CONDUIT

BACKGROUND OF THE INVENTION

1. Field of the Invention

This invention relates generally to electrostatic spray guns, and more particularly relates to a removable cartridge type paint supply conduit which is used with an electrostatic spray gun to allow the gun to be used with moderately conductive as well as nonconductive paints.

2. Description of the Prior Art

Various electrostatic spray coating processes and guns have been known for a considerable time. In general, electrostatic spray coating devices have increased painting efficiency over non-electrostatic types. In principle, such systems operate as follows. Paint is atomized by a spray coating nozzle. Either prior to, at the time of, or just after atomization, the paint is electrically charged to some high voltage potential. The charging system generally operates at a potential on the order of several tens of kilovolts. In the usual situation electrostatic spray systems are used to coat electrically conductive or at least partially conductive objects. These objects are held at ground voltage potential by some appropriate means. Electrostatic forces between the charged paint and the grounded conductive object causes the paint to be drawn to the object to be coated. Because of these electrostatic forces, such phenomena as "overspray" are reduced. The electrostatic forces draw much of the atomized paint, which would otherwise have missed the object, back toward the object.

In order to charge the paint in an electrostatic spray coating system it is necessary to have some means of applying the charge to the paint. In a large majority of the systems used today charging is accomplished by an electrode connected to a high voltage power supply. The electrode is placed in close proximity to or even in contact with the stream of fluid either just prior to or very close to the point of atomization. This process works well when spraying nonconductive paints, however, when spraying paints which are moderately conductive, having for example resistivity of 200,000–1,000,000 ohm-centimeters such as metallic paint, certain precautions must be taken to prevent the high voltage at the electrode from being short circuited to ground through the column of paint.

One approach was to isolate the entire paint supply system from ground potential. This allowed the entire paint system to "float" at the charging potential. However, such an approach had several drawbacks. One of the major drawbacks was that an enormous amount of electrical energy was capacitively stored in the system. This capacitively stored energy could inadvertently be discharged in a spark, causing either an electrical shock to operating personnel, or possibly causing an explosion in an explosive environment like that which exists where solvent based paints are being sprayed.

Another approach was to ground the paint supply container, and to connect the spray gun to the container with a hose which was long enough to make the total electrical resistance of the paint column between the gun and the container large enough for moderately conductive paints so as to reduce electrical current through the paint column to a level that did not short out the electrode. However, this approach had distinct disadvantages. The paint supply hose in such systems was necessarily very bulky and hard to manage when used with a hand held gun. These hoses had to be bulky in order to provide the necessary electrical insulation, and possibly even a grounded conductive layer surrounding the hose. From an operator's point of view this approach was very burdensome.

U.S. Pat. Nos. 2,739,838 and 2,784,350 issued to Sedlacsik, German Pat. No. 2,111,271 and French Pat. No. 2,082,706 all teach various approaches to increasing the length of the paint supply hose. These devices have paint supply conduit in the form of a spiral. This allows the increased length of hose to be in a compact form. One approach mounted the spiraled coil remotely from the spray gun, and the others formed a spiral conduit either inside the barrel of a hand gun or formed a spiral conduit by wrapping a polyethylene hose around the barrel of the gun. Even the best of these approaches had serious drawbacks which prevented the design from becoming a viable commercially desirable product. In these prior art devices, almost invariably, polyethylene was used to form the spiral conduit. However, polyethylene is not impermeable to polar type solvents which are used in a large number of the moderately conductive metallic paints. Polar type solvents are solvents wherein either the molecules exhibit a separation of positive and negative charges, or wherein the centers of positive and negative charges do not coincide, for example the alcohols and ketones. These solvents are chemically active and react with the polyethylene. Because of the chemical reaction the polyethylene would tend to develop microscopic pores which would reduce or eliminate the insulating properties of the conduit. Therefore, in a hand held gun the spiral conduit of necessity was required to be placed at a distance from the operator's hand. The only practical location for the spiral was either in or around the barrel of the gun. However, this additional paint column in the barrel of the gun made the gun "front heavy" and caused severe fatigue to the operator. The spiral conduit could not have been repositioned closer to the pivot point round which the operator's hand moved since the permeability of the material used for the conduit would eventually allow the operator to be shocked if the conduit was moved any closer to his hand.

Further, the same "front heaviness" would be experienced with these prior art guns even if they were used to spray nonconductive paints. The spiral conduit could possibly have been replaced with a straight tube, but not easily. Nor could a damaged coil be replaced on the gun easily and efficiently.

Thus, no one in the past has produced a gun compatible with a spiraled conduit which was self contained, easily removed and compactly stored, and yet was not excessively front heavy and was still safe without the need for a bulky hose which had to be dragged around with great difficulty.

SUMMARY OF THE INVENTION

The present invention relates to a fluid conduit cartridge used with a hand held electrostatic spray coating gun when the gun is to be used to spray paints which are moderately electrically conductive. The cartridge itself has an elongated spiral passage through it, and an inlet to the passage and an outlet from the passage in spaced apart relation along the general direction of the elongation of the spiral. The interior of the passage is impermeable to polar solvents. The inlet and outlet of the passage in one embodiment can be adapted to be sealably but removably connected between an inlet opening in the barrel of the gun and a link in the paint supply hose which electrically grounds any paint passing through it.

It is an object of this invention to provide a spiraled conduit in a hand held electrostatic paint spray gun for moderately conductive paints in such a manner that it is safe and easily held and maneuvered by an operator.

It is another object of this invention to provide such a conduit in the form of a self contained compact and removable cartridge.

Still another object of this invention is to provide a gun with such a cartridge which is itself compact.

DESCRIPTION OF THE DRAWING

The above and other advantages will become apparent upon reading the following description of a preferred embodiment of the invention in which:

The FIGURE represents a partial cross sectional view of a hand held electrostatic spray gun in conjunction with a spiraled paint conduit.

DESCRIPTION OF THE PREFERRED EMBODIMENT

In general, the spray gun 1 in the FIGURE has a handle portion 6 and a barrel portion 7. An electrical circuit 8 extends through the handle 6 and to the barrel 7 through a passage 9 in the handle 6 and the barrel 7. Paint is supplied to an opening 2 in the side of the barrel 7. Paint supplied to the opening 2 in the barrel 7 is directed through a series of passages and valving means (not shown) and is atomized and charged to a high voltage potential by means of an electrode (not shown) proximate the fluid discharge orifice of a spray coating nozzle.

The spray gun 1 can be identical to that disclosed in U.S. Pat. No. 3,747,850 issued to Hastings, et al. The details of the operation of such a gun are described therein, and therefore the disclosure of that patent is incorporated herein by reference.

The handle 6 of the gun 1 is made of electrically conductive material and is connected to ground potential.

A removable paint conduit cartridge 5 is sealably attached between the material passage opening 2 in the side of the barrel 7 of the gun 1 and an electrically conductive link 10. The conductive link 10 can be made of aluminum. The conductive link 10 has a paint passage 11 through it. At either end of the passage 11 suitable means are provided to make hydraulic connections. The interior of the passage 11 in the link 10 is electrically uninsulated. Therefore, any electrically conductive or moderately conductive paint in the passage 11 would be at the same electrical potential as the link 10 itself. The link 10 is supported by a distal end or base of the grounded handle 6. Electrical contact is made between the link 10 and the base of the handle 6, thereby grounding the conductive link 10 and hence any paint in the passage 11 of the link 10.

The cartridge 5 is comprised of a tube 12 formed into an elongated spiral for the majority of its length. The cartridge 5 is supported at its ends by generally funnel shaped supports 13, 14, made from "Nylon". Discharge-end and supply-end supports 13 and 14 respectively are held together in a compact form and unitary assembly by means of shrink tubing 15.

The small ends of the two supports 13, 14 are adapted to be removably connected, one to the material passage opening 2 in the barrel 7 of the gun 1 and the other to the conductive link 10. Passages through the smaller end of each funnel shaped support 13, 14 are circular in cross section and provide a clearance opening for the ends of the tube 12. The ends of the tube 12 are inserted through the openings in the ends of the supports 13, 14, after which the ends of the tube 12 are flared by well known heating/forming methods. The flared ends are in urged contact to annular lips 16, 17 which are around the material passage opening 2 in the barrel 7 of the gun 1 and the opening through the passage 11 in conductive link 10. They provide a seal between the tube 12 and annular lips 16, 17.

Threads on the exterior surface of the smaller end of the discharge-end support 13 allow the cartridge to be screwed into the material passage opening 2 in the barrel 7 of the gun 1. The cartridge is screwed in until the flare on the tube 12 is urged against lip 16.

The shrink tubing 15 allows the cartridge 5 to be compressed slightly in the direction of the elongation of the spiral, therefore after the smaller end of the discharge-end support 13 is screwed into the opening 2 on the barrel 7 of the gun 1, the small end of the supply-end support 14 can be positioned in hydraulic contact with the paint passage 11 in the conductive link 10. A locking ring 20 holds a nut 21 to the small end of the supply-end support 14. The nut 21, when tightened, urges the small end of the supply-end support 14, and hence the flared tube 12 against the lip 17 around the paint passage 11 in the conductive link 10.

Rubber washers 18, 19 are positioned between the faces of each smaller end of the supports 13, 14 and the flared portions of the ends of tube 12.

The nut 21 is threaded onto the conductive link 10 in sealable yet removable manner.

The spiral tube 12 is made from Teflon, which is a fluorinated hydrocarbon. The word "Teflon" is a trade name, however the word will be used herein as a short designation of tetrafluoroethylene. Teflon has good insulation or dielectric properties and it has been found that the fluorinated hydrocarbons are impermeable to the polar type solvents used in many of the metallic paints and also impermeable to many other types of solvents. By making the spiral tube from a substance which is impermeable to the polar type solvents and other solvents as well, it will be appreciated that the physical and electrical properties of the tube 12 will not break down after a period of use. Therefore, the spiral can be positioned such that it does not cause the gun 1 to be front heavy, and such that it can be removed easily when desired, for example when the paint will be changed to a nonconductive type, or when the cartridge 5 is damaged.

It has been found that satisfactory results are achieved if the inside diameter of the Teflon tube 12 is 3/16", the outside diameter is ¼", and the length of the Teflon tube 12 uncoiled is 48".

The dimensions of the spiral conduit depend on several factors including the characteristics of the high voltage power supply intended for use, the resistivity of the paint to be sprayed, and the system pressure drops. The inside cross-sectional dimensions of the tube 12 must be large enough to supply the needed quantity of paint to the gun at a proper operating pressure. However, it is to be appreciated that as the inside cross-sectional dimensions of the tube 12 are increased, the electrical resistance of the paint column in the tube 12 per unit length of conduit is reduced. Therefore, small cross-sectional dimensions are desirable. After selecting the inside cross-sectional dimensions of the tube, the length of the tube is determined. The total electrical resistance from the electrode through the paint column in the tube to the grounded end of the tube must maintain this leakage current through the paint column below a level which would short out the charging electrode. That is, this leakage current must not load the charging electrode such that the voltage at the electrode is below its desired operating level. This level may change depending on the operating characteristics of individual high voltage power sources.

If desired a backing material 22 can be used between the shrink tube 15 and the coiled Teflon tube 12 for cosmetic purposes, that is to take away the ridges on the exterior of the cartridge 5. A glass filled Teflon sheet has been found satisfactory.

Having described my invention, I claim:

1. In an electrostatic hand held liquid coating gun for moderately conductive paints including those paints using a polar type solvent, the gun having a barrel, at one end of which barrel paint is atomized and electrically charged, the other end of which barrel is supportably connected to a handle assembly having a distal base, and which extends at an angle from said barrel, the barrel further comprising a passage for the paint which will be atomized, an opening through the side of the barrel in fluid communication with said passage and adapted to be connected to a source of paint under pressure, the improvement which comprises:

a dielectric conduit spiraled for a substantial portion of its length in non-encompassing relationship with said barrel, having a first end in hydraulically sealable fluid connection to the opening of said barrel and a second end adapted to be connected in spaced apart relation from said first end to a source of paint under pressure; and conductor means in electrical contact with any liquid in said conduit at a point proximate said second end of said conduit; said conductor means further being electrically connected to ground potential.

2. The apparatus of claim 1 wherein the conduit is impermeable to polar solvents.

3. The apparatus of claim 2 wherein the spiraled passage extends between the opening in said barrel and a point proximate the base of said handle.

4. The apparatus of claim 3 wherein said conductor means is a metallic member having an electrically uninsulated passage through it, one end of the passage being adapted to be connected to a source of paint under pressure, and the other end of said passage connected to said second end of said spiral conduit.

5. The apparatus of claim 1 wherein the fluid connections at either end of the spiraled conduit are reusable, unfastenable mechanical connections.

6. The apparatus of claim 5 wherein the conductive means is a metallic member having an electrically uninsulated passage through it, one end of the passage being adapted to be connected to a source of paint under pressure and the other end of said passage being connected to said second end of said spiraled conduit.

7. A fluid conduit cartridge for use with a hand held electrostatic spray gun comprising:

a member having a passage therethrough in the form of a spiral and having an inlet to said passage and an outlet from said passage in spaced apart relation from one end of the spiral to the other, said passage being impermeable to polar solvents, the inlet and outlet of said passage being sealably but removably connectable to separate fluid passages and adapted to be supported between the barrel and handle of an electrostatic spray coating gun; and means retaining said passage in a compact and spiraled form.

8. The apparatus of claim 7 wherein said passage is formed from a tube.

9. A fluid conduit cartridge for use with a hand held electrostatic spray gun having a barrel and handle, comprising:

a tube impermeable to polar solvents, forming a fluid passage spiraled for the greater portion of its length, each end of which tube passes through separate supports in spaced apart relationship with each other;

means holding the spiraled passage and supports in a compact and unitary assembly; and hydraulic fittings at each end of the tube, one adapted to connect one end of the tube to a pressurized source of paint at a distal end of the handle of the spray gun, and the other adapted to connect the other end of the tube to a paint supply conduit opening in the side of the barrel of the spray gun.

10. The fluid conduit cartridge of claim 9 wherein the tube is made of polytetrafluoroethylene.

11. The fluid conduit cartridge of claim 10 wherein said tube is forty-eight inches long, has an inside diameter of three-sixteenths of an inch and an outside diameter of one quarter inch.

12. The fluid conduit cartridge of claim 11 wherein said supports are funnel shaped.

* * * * *